United States Patent [19]

Twort

[11] 4,189,301

[45] Feb. 19, 1980

[54] REINFORCED INSULATING MEMBERS

[75] Inventor: Thomas J. Twort, Greenford, England

[73] Assignees: Bloom Engineering Company, Inc., MIddlesex, United Kingdom; GB2; Bloom Engineering Company, INc., Pittsburgh, Pa.

[21] Appl. No.: 899,451

[22] Filed: Apr. 24, 1978

[30] Foreign Application Priority Data

May 6, 1977 [GB] United Kingdom ..... 19128/77

[51] Int. Cl.[2] ..... F27D 1/06

[52] U.S. Cl. ..... 432/252; 110/336; 432/234

[58] Field of Search ..... 432/233, 234, 237, 238, 432/252; 110/336

[56] References Cited

U.S. PATENT DOCUMENTS

| | | | |
|---|---|---|---|
| 2,693,352 | 11/1954 | Bloom | 432/234 |
| 2,867,112 | 1/1959 | Krone | 110/336 |
| 3,647,194 | 3/1972 | Brungraber et al. | 432/234 |
| 3,742,670 | 7/1973 | Byrd, Jr. | 110/336 |

FOREIGN PATENT DOCUMENTS

| | | |
|---|---|---|
| 1369283 | 10/1974 | United Kingdom . |
| 1441915 | 7/1976 | United Kingdom . |

*Primary Examiner*—John J. Camby

*Attorney, Agent, or Firm*—Webb, Burden, Robinson & Webb

[57] ABSTRACT

A thermally insulating member for protecting water cooled pipes in the supporting structures for work pieces in heat treating furnaces comprises a cast refractory insulating member into which is solidly embedded a reticulated metal mesh reinforcement member. To provide further substantial reductions in the amount of heat loss by decreasing the thermal conductivity of the insulating member a fibrous insulating material is engaged within mesh loops of the reticulated metal structure. The fibrous insulating material has better heat insulating properties than the cast refractory material.

6 Claims, 2 Drawing Figures

REINFORCED INSULATING MEMBERS

FIELD OF THE INVENTION

This invention relates to thermally insulating members for mounting within high temperature furnace chambers, particularly members for mounting to water cooled pipes in the supporting structures for work pieces in heat treating furnaces.

BACKGROUND OF THE INVENTION

A supporting structure within a furnace chamber where temperatures may be in the order of 2000° F. must be compact in order to leave sufficient combustion space in the chamber, must be strong enough to support heavy metal work pieces being treated in the furnace, and must be protected against injury by the high temperature within the furnace while at the same time not seriously interfering with the efficiency and maximum temperature of a furnace. It must also be strong enough to withstand the stresses and heavy vibration set up by the movement of the heavy work pieces within the heating chamber.

Refractory insulating materials have been used for a number of years in the production of cast insulating bodies required to line heat treating furnaces and insulate supporting structures within the interior of heat treating furnaces. More recently the advantageous insulating properties attainable by use of suitable fibrous insulating materials have become recognised, and it has been desired to find ways of utilising these materials to produce insulating members for use in heating furnaces and the like. However, the structural strength of these materials is low and does not meet all service conditions.

SUMMARY

The present invention provides a thermally insulating member comprising a refractory insulating material, a metal mesh reinforcement member structure embedded at least partly within the refractory insulating material and a fibrous insulating material engaged within mesh loops of the reinforcement member.

The metal mesh reinforcement member acts as a reinforcement and support for the fibrous insulating material giving to it a high degree of structural strength and integrity.

The fibrous insulating material decreases the thermal conductivity of the insulating member with very substantial reductions in the amount of heat loss. Since the metal mesh reinforcement member is at least partly embedded in the refractory insulating material it is able to reinforce the refractory material and impart a high degree of strength to the cast piece.

Preferably, the fibrous insulating material is in the form of strips of material which are engaged within the mesh loops of the metal reinforcement member and do not fill said mesh loops completely, other portions of the mesh loops not filled by the strips being embedded in the refractory insulating material.

The object of the invention is to attain all the advantages of a metal reinforced refractory body and a high heat-insulating fibrous material in a single integral structural unit and the engagement of the fibrous material within the reinforcement loops in conjunction with the embedding of the loops in the refractory material constitutes a secure means of fixing the fibrous material so that the latter will withstand arduous service conditions such as are encountered in a heat treating furnace.

The fibrous insulating material is preferably a material having higher heat-insulating properties than the castable refractory material. Various fibrous insulating materials are contemplated for use in this invention. Ceramic fibre material is especially preferred, but glass fibres, asbestos fibres and high-grade synthetic fibres are examples of other suitable insulating materials.

Another object of the invention is to provide a method of producing an insulating member as above by initially threading strips of the fibrous insulating material into the reticulated metal reinforcement member such that mesh loops of the member are not filled completely, and then casting a dense refractory insulating material to engage unfilled portions of the mesh loops.

DESCRIPTION OF THE PREFERRED EMBODIMENT

Figure 2:
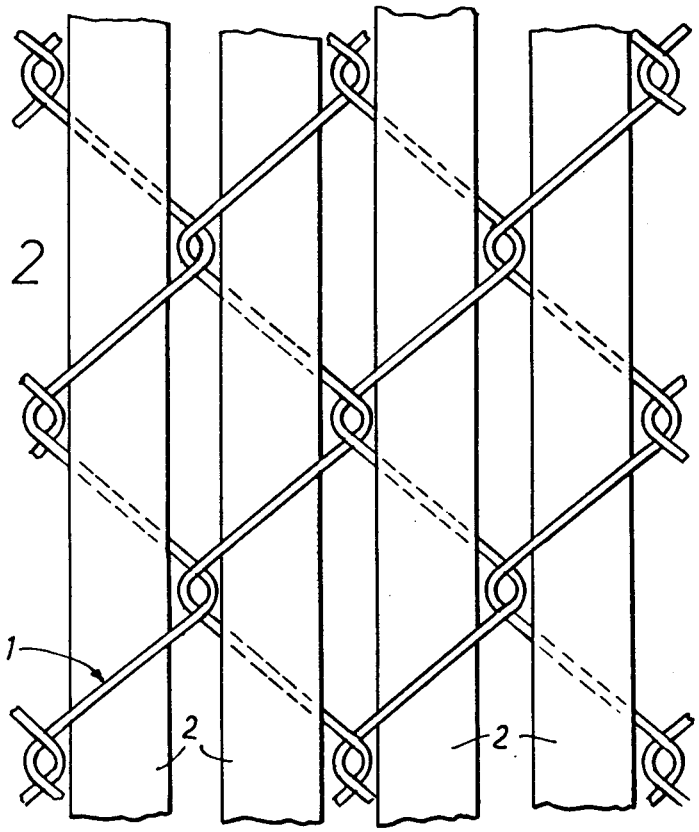

Referring first to FIG. 2, there is shown a portion of metal mesh reinforcement member 1. The member 1 may comprise any suitable open work metal member, such as expanded metal or a woven wire fabric, but is preferably a reticulated metal structure comprising interlocking coils of wire extending parallel to each other. Strips 2 of a fibrous insulating material as referred to above, e.g. a ceramic fibre material, are threaded through the wire loops of the member 1. The strips 2 lie generally in the plane of the member, and are parallel. If desired, other strips 2 (not shown) may also be threaded through the wire loops in a transverse direction.

The strips 2 do not completely fill the wire loops so that when a refractory insulating material is subsequently cast onto the structure illustrated in FIG. 2, the cast refractory material enters the wire loops and the reinforcement member at least is partly embedded within the refractory insulating material to reinforce both the refractory and the fibrous materials and create a bond between the two materials which imparts a high degree of strength to the entire insulating member. The application in this manner of an outer covering layer of a dense refractory material greatly increases the ability of the member to withstand the effects of high velocity gas erosion at the temperatures encountered in heat treating furnaces.

Figure 1:
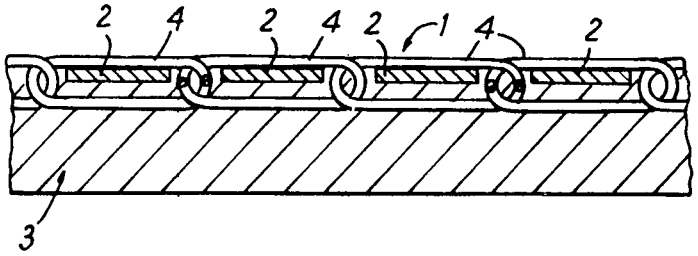
FIG. 1 is a cross-sectional view showing a portion of an insulating member in accordance with the invention and FIG. 2 is a plan view showing a wire fabric reinforcement member and strips of a fibrous insulating material inserted through the wire loops, prior to casting on the refractory material.

FIG. 1 shows a portion of such a thermally insulating member whereof the reinforcement member 1 is only partly embedded within the cast refractory material 3 so that portions of the wire loops 4 are exposed at the inner surface of the member for welding to a pipe in a heat treating furnace. If desired, the member 1 may be wholly embedded in the refractory material 3, other arrangements being made to anchor the member in position in the furnace.

Insulating members in accordance with the present invention may in all other respects be similar to the members disclosed in U.S. Pat. Nos. 2,693,352 and 3,647,194 or in United Kingdom Patent Specifications No. 1,369,283 and 1,441,915, to which reference may be made for relevant details. The invention may in particular be applied in the production of the insulating members disclosed in Patent Specifications No. 1,369,283 and 1,441,915.

I claim:

1. A thermal insulating member for protecting heat absorptive elongated elements in a high temperature heat treating furnace comprising a refractory insulating material, a reticulated metal mesh reinforcement structure defining a plurality of interconnected loops and embedded at least partly within the refractory insulating material and a fibrous insulating material interwoven within said loops.

2. A member as claimed in claim 1, wherein the fibrous insulating material is comprised of ceramic fibres.

3. A member as claimed in claim 1, wherein the fibrous insulating material is comprised of glass fibres.

4. A member as claimed in claim 1, wherein the fibrous insulating material is comprised of asbestos fibres.

5. A member as claimed in claim 1, wherein the fibrous insulating material is comprised of synthetic resin fibres.

6. A member as claimed in claim 1, wherein the fibrous insulating material is in the form of strips of material which are engaged within the mesh loops of the metal reinforcement member and do not fill said mesh loops completely, other portions of the mesh loops not filled by the strips being filled by the refractory insulating material.

* * * * *

UNITED STATES PATENT AND TRADEMARK OFFICE

CERTIFICATE OF CORRECTION

PATENT NO. : 4,189,301

DATED : February 19, 1980

INVENTOR(S) : Thomas J. Twort

It is certified that error appears in the above—identified patent and that said Letters Patent is hereby corrected as shown below:

On the title page, item /73/ should read

-- Assignees: Urquhart Engineering Company, Limited, Middlesex, England and Bloom Engineering Company, Inc., Pittsburgh, Pa.

Signed and Sealed this

*Third* Day of *June 1980*

[SEAL]

*Attest:*

SIDNEY A. DIAMOND

*Attesting Officer*

*Commissioner of Patents and Trademarks*